United States Patent [19]

Shishkin et al.

[11] Patent Number: 4,756,237

[45] Date of Patent: Jul. 12, 1988

[54] DEVICE FOR CONVERTING ENERGY OF FLUID MEDIUM INTO MECHANICAL WORK OF WORKING MEMBER

[75] Inventors: Viktor V. Shishkin; Nikolai F. Kryazhevskikh; Jury P. Shapovalov, all of Krasnodar, U.S.S.R.

[73] Assignee: Trest "Juzhvodoprovod", Krasnodar, U.S.S.R.

[21] Appl. No.: 110,703

[22] PCT Filed: Dec. 17, 1986

[86] PCT No.: PCT/SU86/00134

§ 371 Date: Jul. 16, 1987

§ 102(e) Date: Jul. 16, 1987

[87] PCT Pub. No.: WO87/03939

PCT Pub. Date: Jul. 2, 1987

[30] Foreign Application Priority Data

Dec. 24, 1985 [SU] U.S.S.R. ..... 3988762

[51] Int. Cl.[4] ..... F15B 11/00; F15B 13/00

[52] U.S. Cl. ..... 91/534; 92/48; 92/69 R; 92/75; 92/50; 92/89; 92/90; 92/91; 92/92

[58] Field of Search ..... 91/534; 92/48, 50, 75, 92/69, 89, 90, 91, 92

[56] References Cited

U.S. PATENT DOCUMENTS

| | | | |
|---|---|---|---|
| 213,745 | 4/1879 | Fuller | 92/50 |
| 706,637 | 8/1902 | Clough | 92/69 R |
| 2,019,316 | 10/1935 | Morey | 92/89 |
| 3,315,606 | 4/1967 | Piros | 92/48 |
| 3,369,733 | 2/1968 | Campbell | 92/69 |
| 3,381,583 | 5/1968 | Vansteene | 92/90 |
| 3,417,942 | 12/1968 | Alstyne | 92/90 |
| 3,471,668 | 10/1969 | Wilkes | 92/89 |
| 4,010,611 | 3/1977 | Zachery | 92/75 |
| 4,094,227 | 6/1978 | King | 92/69 R |
| 4,203,351 | 5/1980 | Schwind | 92/69 R |
| 4,305,327 | 12/1981 | Willat | 92/90 |
| 4,404,924 | 9/1983 | Goldberg et al. | 92/92 |
| 4,453,508 | 6/1984 | Groeger | 92/90 |
| 4,616,556 | 10/1986 | Meilman et al. | 92/48 |
| 4,645,182 | 2/1987 | Stoll | 92/92 |

FOREIGN PATENT DOCUMENTS

| | | | |
|---|---|---|---|
| 55955 | 3/1945 | France | 92/75 |

*Primary Examiner*—Robert E. Garrett
*Assistant Examiner*—Thomas Denion
*Attorney, Agent, or Firm*—Burgess, Ryan & Wayne

[57] ABSTRACT

According to the invention, the device comprises a housing (1), two chambers (2, 3) interconnected through a pipeline (4) and disposed in the housing opposite to each other. Each chamber (2 or 3) has a piston made in the form of an elastic sleeve (10 and 11), whose one end is turned inside out and secured to the inner surface of the pipeline (4) at the point of its connection to the chamber (2 to 3). Each piston is kinematically connected to the working member (7) via a shaft (5 or 6) mounted in the chamber (2 to 3), one end of which is kinematically connected to the working member (7), and a drum (8 or 9) connected to the other end of the shaft (5 or 6) and provided with a reverser. Secured on the drums (8 and 9) are the other ends of the sleeves (10 and 11). The pressure space formed by the spaces of the chambers (2, 3) and the space of the pipeline (4) is communicated with a fluid medium supply system (14).

6 Claims, 2 Drawing Sheets

DEVICE FOR CONVERTING ENERGY OF FLUID MEDIUM INTO MECHANICAL WORK OF WORKING MEMBER

TECHNICAL FIELD

The present invention relates to volume displacement machines and, more particularly, the invention relates to devices for converting energy of a fluid medium into mechanical work of a working member.

PRIOR ART

At the present time the convertion of energy of a fluid medium into mechanical work of a working member is effected by well known piston engines comprising a chamber in which a piston made of a rigid material and provided with movable seals. However, these machines have the following disadvantages:

low reliability and useful life due to frequent failure of the movable seals;

high requirements imposed on the accuracy and surface finish of the chamber and piston, which do not allow modern technology to make the chambers with a volume exceeding 1 $m^3$;

a short stroke of the piston due to a limited volume of the chamber and structural rigidity.

This made it necessary to develop such devices for converting energy of a fluid medium into mechanical work of a working member, which are provided with pistons made of an elastic material.

Known in the art is a device for converting energy of a fluid medium into mechanical work (cf. French Pat. No. 788197, NPC 46 a $^{10}2$, published in 1935) comprising a housing and two chambers disposed in this housing in opposition to each other. Each chamber has a piston made of a rigid material and coupled to a working member through a two-sided rack interconnecting both said pistons. When the pistons reciprocate, the two-sided rack rotates the working member gear wheel.

The prior art device does not provide a large stroke of the working member per piston stroke, which is limited by the chamber length. The chamber cannot be made of a large length due to the high requirements imposed on the accuracy and surface finish of the chambers and pistons and due to low tolerances to the coaxial alignment of both chambers. Owing to the rigid mounting of the pistons and working member the device does not provide automatic centring of the pistons relative to the working member and simultaneous transmission of their forces to the working member and this limits the field of application of this device; for example, it cannot be used for driving the working tool of a metal drawing machine. The device also cannot be used as a motor moving along a rope since the device itself cannot move along the working member. Furthermore, the device features low efficiency due to a limited stroke of the piston inside the chamber and the absence of simultaneous transmission of the forces of the pistons to the working member, since the filling of the chambers with the fluid medium is effected alternately.

ESSENSE OF THE INVENTION

It is an object of the present invention to provide a device for converting energy of a fluid medium into mechanical work of a working member, featuring such a structural design of pistons thereof and their interconnection which ensure an increased length of the working member stroke per cycle of the piston reciprocation, simultaneous transmission of forces of the both pistons as well as their reciprocations to the working member, whereby technological facilities of the device are made broader, the efficiency thereof is raised and the design is simplified.

This object is attained in a device for converting energy of a fluid medium into mechanical work of a working member comprising a housing, two chambers disposed in the housing oppositely to each other, each chamber having a piston connected to the working member through a kinematic connection; and a system with a distribution valve for supply of a fluid medium, in which, according to the invention, the chambers are interconnected through a pipeline having a pressure space communicating with the fluid medium supply system; the kinematic connection of each piston with the working member includes a shaft mounted in the chamber, one end of this shaft being kinematically connected to the working member; and a drum connected to the other end of the shaft and provided with a reverser; each piston is made in the form of an elastic sleeve whose one end is turned inside out and secured on the inner surface of the pipeline at the point of its connection with the chamber, while the other end of the sleeve is secured on the drum.

In order to provide continuous rotation of the working member, it is necessary that the first elastic sleeve be wound on the corresponding drum, while the other elastic sleeve extends along the pipeline throughout the entire length of the sleeve and has one end secured to the drum so that its winding on the drum is effected in a direction opposite to the direction of winding of the first elastic sleeve; the fluid medium supply system would be communicated with the spaces of the chambers, while the pipeline space between the surfaces of the elastic sleeves would be filled with a fluid medium.

In order to provide reversible rotation of the working member, it is expedient that the first elastic sleeve be wound on the corresponding drum, while the second elastic sleeve extends along the pipeline throughout its entire length and has one end secured on the drum so that its winding on the drum would be effected in a direction coinciding with the direction of winding of the first elastic sleeve; the fluid medium supply system is communicated with the spaces of the chambers, while the pipeline space between the surfaces of the elastic sleeves is filled with a fluid medium.

This makes it possible to use the claimed device in grinding and drawing machines.

In one embodiment of the invention the elastic sleeves are preferably extended along the pipeline through their whole length, in which case the pipeline space must be communicated with the fluid medium supply system and with the ambient atmosphere, while the chambers are filled with fluid medium.

This makes it possible to simplify the design of the device having a considerable length.

Furthermore, this embodiment allows one to store energy, e.g. of a liquid or gas, in pipelines while reducing their consumption; when the energy consumed by the working member (e.g. centrifugal pump) increases, the fluid medium being transported can be pumped into the pipeline.

It is desirable that the kinematic connection of each shaft with the working member is effected by means of ratchet half-couplings and gear wheels mounted on the shaft and a gear wheel mounted on the working member shaft.

Such coupling of the shaft with the working member makes it possible to reduce the device length.

The reverser of each drum may be made in the form of a laminar spring, one end of which is secured on the drum while the other end is fixed to the chamber wall.

This makes it possible to simplify the design of the device.

SUMMARY OF THE DRAWINGS

The invention is further described by way of example with reference to the accompanying drawings, in which.

PREFERRED EMBODIMENT OF THE INVENTION

Figure 1:
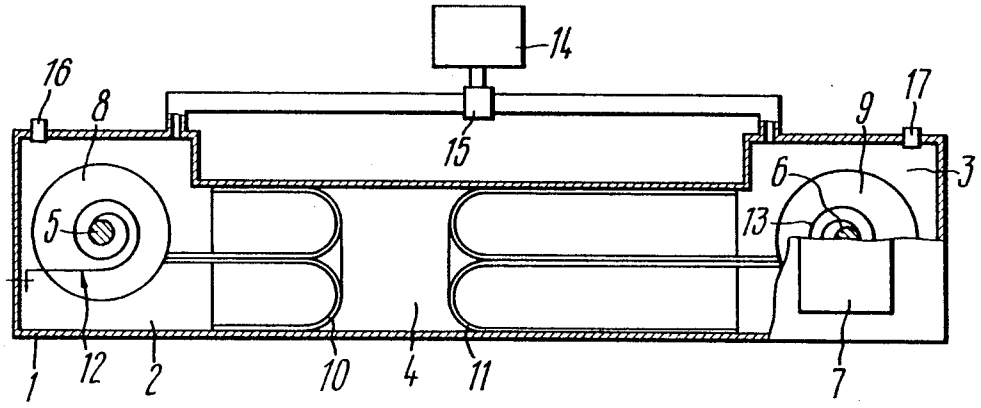
FIG. 1 shows the design of the device for converting energy of a fluid medium into mechanical work of a working member, according to the invention.

The claimed device for converting energy of a fluid medium into mechanical work of a working member comprises a housing 1 (FIG. 1), two chambers 2 and 3 located in the housing in opposition to each other and interconnected through a pipeline 4 to form a pressure space. Mounted in the chambers 2 and 3 on shafts 5 and 6 kinematically connected to a working member 7 are drums 8 and 9. The pistons are made in the form of elastic sleeves 10 and 11 whose ends are secured on drums 8 and 9 respectively. The other ends of the elastic sleeves 10 and 11 are turned inside out and secured on the inner surface of the pipeline 4 at the point of its connection with the chambers 2 and 3. The drums 8 and 9 are equipped with reversers made in the form of laminar springs 12 and 13, one end of each spring being secured on the drum 8 or 9 and the other end being fixed to the wall of the chamber 2 or 3. The chambers 2 and 3 are communicated with the fluid medium supply system via a distribution valve 15 and have valves 16 and 17 for discharging the used fluid medium, the space of the pipeline 4 between the sleeves 10 and 11 being filled with a fluid medium, e.g. gas or liquid. The sleeve 10 is wound on the drum 8, while the sleeve 11 is extended along the pipeline 4 through the whole length of the sleeve and is secured so that its winding on the drum 9 is effected in a direction opposite to the direction of winding of the sleeve 10.

Figure 2:
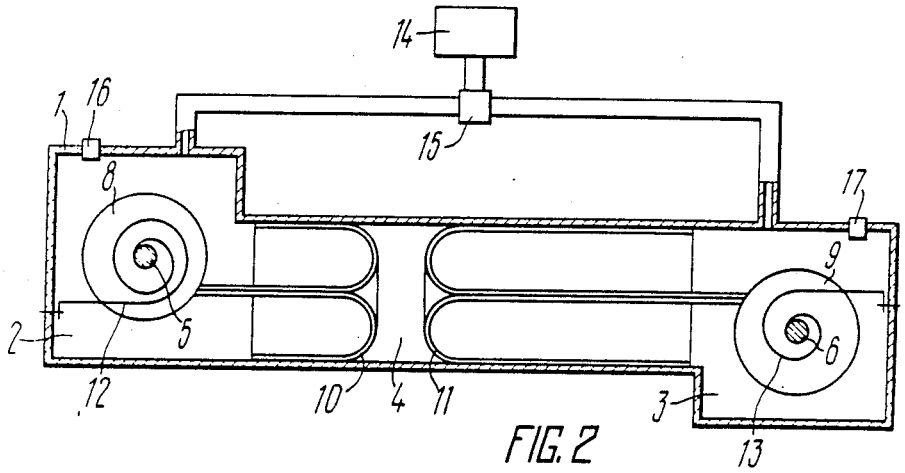
FIG. 2 shows an embodiment of the device, in which the sleeves are secured on the drums in different ways, according to the invention.

To provide continuous rotation of the working member 7, the sleeve 11 (FIG. 2) is extended along the pipeline 4 through the whole length of the sleeve and is secured on the drum 9 so that it is wound thereon in a direction coinciding with the direction of winding the sleeve 10.

Figure 3:
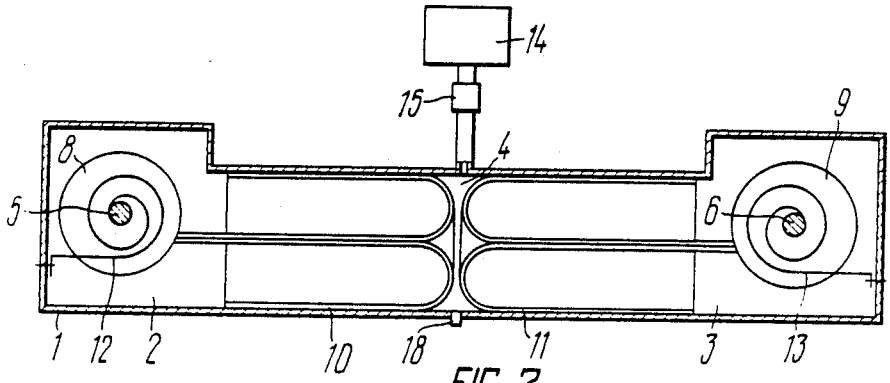
FIG. 3 shows another embodiment of the device, in which the fluid medium supply system is communicated with the pipeline, according to the invention.

To simplify the design of the device having a pipeline 4 of a considerable length (FIG. 3), when both sleeves 10 and 11 are stretched along the pipeline 4, while the fluid medium supply system 14 is directly communicated with the space of the pipeline 4, the latter is provided with a valve 18 for discharging the used fluid medium, while the chambers 2 and 3 are filled with a fluid medium preliminarily, prior to installation of the sleeves 10 and 11.

Figure 4:
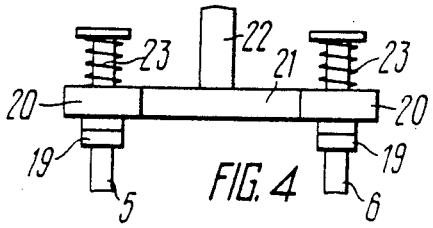
FIG. 4 shows the kinematic connection of the shaft with the working member, according to the invention.

The kinematic connection of the shafts 5 and 6 with the working member 7 (FIG. 1) is effected by means of single-side half couplings 19 (FIG. 4), e.g. ratchet couplings, and gear wheels 20 mounted on the shafts 5 and 6, and a gear wheel 21 mounted on a shaft 22 of the working member 7 (FIG. 1). The gear wheels 20 are pressed to the half-couplings 19 by springs 23.

The claimed device operates as follows.

In the initial position the sleeve 10 (FIG. 1) is wound on the drum 8 and the spring 12 is coiled. The distribution valve 15 switches the system 14 for supply of a fluid medium, e.g. gas, into the chamber 2. In doing so, the valve 16 is closed, while the valve 17 is open. The sleeve 10 is unwound from the drum 8 transmitting a torque to the shaft 5 and coiling the spring 12.

In this case the sleeve 11 is wound on the drum 9 under the effect of the gas pressure developed in the pipeline 4 during the unwinding of the sleeve 10 and under the action of the force produced by the uncoiling spring 13. The valve 16 of the chamber 2 opens, while the valve 17 of the chamber 3 closes. The distribution valve 15 switches the system 14 for supplying the gas into the chamber 3. The sleeves 10 and 11 move in reverse directions: the sleeve 10 is wound on the drum 8, while the sleeve 11 is unwound from the drum 9. The fluid medium is fed into the chamber 2 and the whole operating cycle of the device is repeated. In this case the shafts 5 and 6 rotate in opposite directions: one of them performs a working stroke, while the other one performs an idle run.

In order to provide reversible rotation of the shafts 5 and 6 (this is necessary when moving the working member during grinding, planing or soil cultivation), the ends of the sleeves 10 and 11 (FIG. 3) are secured on the drums 8 and 9 in different directions, in which case the sleeve 10 is wound and the spring 12 is uncoiled, while the sleeve 11 is stretched and the spring 13 is coiled. The valve 15 switches the system 14 for supply of a fluid medium into the chamber 2, in which case the valve 16 of the chamber 2 is closed, while the valve 17 of the chamber 3 is open. The sleeve 10 is being unwound from the drum 8 transmitting a torque to the shaft 5 and coiling the spring 12. In so doing, the sleeve 11 is wound on the drum 9 under the action of the fluid medium in the space of the pipeline 4 and under the force produced when uncoiling the spring 13. The valve 16 of the chamber 2 opens, while the valve 17 of the chamber 3 closes, and the distribution valve 15 switches the system 14 for supply of the fluid medium into the chamber 3. The sleeves 10 and 11 move in a reverse direction. The fluid medium is fed into the chamber 2 and the operating cycle of the device is repeated. During the working stroke the torque is transmitted to the gear wheel 21 mounted on the shaft 22 through the single-side half-coupling 19 (FIG. 4) of the gear wheel 20. The shaft 22 rotates continuously in one direction.

In order to provide rotation of the shafts 5 and 6 (FIG. 3) in opposite directions, the sleeves 10 and 11 in their initial position are unwound from the drums 8 and 9 under the effect of compressed gas in the spaces of the chambers 2 and 3, while the springs 12 and 13 are coiled. The valve 15 is opened and the gas is fed into the space of the pipeline 4. The sleeves 10 and 11 are wound on the drums 8 and 9 under the gas pressure produced in the space of the pipeline 4 and under the action of the force arising when uncoiling the springs 12 and 13. Gas in the chambers 2 and 3 is compressed, then the valve 15 is closed while the valve 18 is opened and under the effect of the compressed gas in the chambers 2 and 3 the sleeves 10 and 11 are unwound from the drums 8 and 9, thus rotating the shafts 5 and 6 and coiling the springs 12 and 13. The valve 18 is closed, gas again is fed into the space of the pipeline 4, and the operating cycle of the device is repeated. In this case the shafts 5 and 6 rotate in opposite directions: one of them performs a working stroke while the other one performs an idle run.

Owing to the fact that the sleeves 10 and 11 move in the pipeline 4 without sliding along its inner sufafce, the claimed invention allows the following positive effects to be obtained:

higher operational efficiency since there is no sliding friction of the sleeves 10, 11 with respect to the pipeline 4;

higher operational reliability and service life of the device since the sleeves 10 and 11 are not subject to wear;

a simplerdesign of the device due to less stringent requirements to the accuracy and surface finish;

the power of the device is increased, because it is possible to drastically increase the pressure in the chambers 2 and 3, since the sleeves 10 and 11 are tightly connected to the chambers 2 and 3;

the specific amount of metal needed for making the device is reduced since the volume of the chambers 2 and 3 may be equal to a few hundred cubic meters.

INDUSTRIAL APPLICABILITY

The invention can be used both in stationary actuating mechanisms and in vehicles.

Furthermore, the invention can successfully be used as a hydropneumatic drive of drawing mechanisms or drives used in machine-tool industry and wood industry for transmitting motion to a working member, e.g. spindle of a grinding or planing machine.

The fluid medium may be gas or liquid.

We claim:

1. A device for converting energy of a fluid medium into mechanical work of a working member comprising a housing (1), two chambers (2, 3) disposed in the housing (1) oppositely to each other, each chamber having a piston connected to the working member (7) through a kinematic connection, and a system (14) for supply of a fluid medium provided with a distribution valve (15), characterized in that the chambers (2,3) are interconnected through a pipeline (4) having a pressure space communicating with the fluid medium supply system (14), whereas the kinematic connection of each piston with the working member (7) includes a shaft (5 or 6) mounted in the chamber (2 or 3) one end of the shaft being kinematically connected to the working member (7), and a drum (8 or 9) connected to the other end of the shaft (5 or 6) and provided with a reverser, each piston being in the form of an elastic sleeve (10 or 11) whose one end is turned inside out and secured to the inner surface of the pipeline (4) at the point of its connection with the chamber (2 or 3), while the other end thereof is secured on the drum (8 or 9).

2. A device according to claim 1, characterized in that the first elastic sleeve (10) is wound on the respective drum (8), while the second elastic sleeve (11) extends along the pipeline (4) throughout the entire length of the sleeve, one end thereof being secured on the drum (9) so that its winding on the drum (9) is effected in a direction opposite to the direction of winding of the first elastic sleeve (10), the fluid medium supply system (14) communicating with the spaces of the chambers (2, 3) and the space of the pipeline (4) defined between the surfaces of the elastic sleeves (10, 11) is filled with a fluid medium.

3. A device according to claim 1, characterized in that the first elastic sleeve (10) is wound on the respective drum (8), while the second elastic sleeve (11) extends along the pipeline (4) throughout the entire length of the sleeve, one end thereof being secured on the drum (9) so that its winding on the drum (9) is effected in a direction coinciding with the direction of winding of the first elastic sleeve (10), the fluid medium supply system (14) communicating with the spaces of the chambers (2, 3) and the space of the pipeline (4) defined between the surfaces of the elastic sleeves (10,11) is filled with a fluid medium.

4. A device according to claim 1, characterized in that the elastic sleeves (10, 11) are extended along the pipeline (4) through their whole length, while the space of the pipeline (4) is communicated with the fluid medium supply system (14) and with the ambient atmosphere, the chambers (2, 3) being filled with a fluid medium.

5. A device according to claim 2, characterized in that each shaft (5 or 6) is kinematically connected to the working member (7) via ratchet half-couplings (19) and gear wheels (20) mounted on the shaft (5 or 6), and a gear wheel (21) mounted on the shaft (22) of the working member (7).

6. A device according to claims 1 to 5, characterized in that the reverser of each drum (8 or 9) is made in the form of a laminar spring (12 or 13) one end of which is secured respectively on the drum (8 or 9), while the other end is fixed to the wall of the chamber (2 or 3), respectively.

* * * * *